US007348729B2

(12) United States Patent
Miyashita et al.

(10) Patent No.: US 7,348,729 B2
(45) Date of Patent: Mar. 25, 2008

(54) PLASMA DISPLAY PANEL AND PRODUCTION METHOD THEREOF AND PLASMA DISPLAY PANEL DISPLAY UNIT

(75) Inventors: Kanako Miyashita, Mishima-gun (JP); Koichi Kotera, Osaka (JP); Akira Shiokawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 535 days.

(21) Appl. No.: 10/362,853

(22) PCT Filed: Aug. 28, 2001

(86) PCT No.: PCT/JP01/07351

§ 371 (c)(1),
(2), (4) Date: Nov. 3, 2003

(87) PCT Pub. No.: WO02/19368

PCT Pub. Date: Mar. 7, 2002

(65) Prior Publication Data

US 2004/0075388 A1 Apr. 22, 2004

(30) Foreign Application Priority Data

Aug. 29, 2000 (JP) ..... 2000-258654
Aug. 29, 2000 (JP) ..... 2000-258660

(51) Int. Cl.
*H01J 17/49* (2006.01)

(52) U.S. Cl. ..... 313/587; 313/586

(58) Field of Classification Search ..... 313/586–587
See application file for complete search history.

(56) References Cited

U.S. PATENT DOCUMENTS 5,922,125 A * 7/1999 Zhang ..... 117/9
2004/0056594 A1* 3/2004 Kotera et al. ..... 313/582

FOREIGN PATENT DOCUMENTS

| | | |
|---|---|---|
| JP | 08-287833 | 11/1996 |
| JP | 09-167566 | 6/1997 |
| JP | 10-162743 | 6/1998 |
| JP | 10-302644 | 11/1998 |
| JP | 11-176325 | 7/1999 |
| JP | 11-339670 | 12/1999 |
| JP | 2000-123745 | 4/2000 |
| JP | 2001-118514 | 4/2001 |
| JP | 2001-226762 | 8/2001 |

* cited by examiner

*Primary Examiner*—Joseph Williams
*Assistant Examiner*—Anthony Perry

(57) ABSTRACT

A plasma display panel having excellent electron emission properties and a method of making the same. A plasma display panel is provided with a protective layer having a dense growth of columnar crystals formed on a dielectric layer. A middle layer can be provided for improving orientation of the columnar crystals. A heating step creates seed crystals to increase the width and growth of columnar crystals with a selective orientation and greater diameter. The area of any exposed surfaces on the protective layer becomes smaller and absorption of impurities decreases. A layer of grain crystals or an amorphic crystal layer is initially deposited on the dielectric layer to establish wider area seed crystals of a desired orientation. A vacuum evaporated complimentary protective layer can then be grown with the improved configuration.

20 Claims, 13 Drawing Sheets

FIG.10

FACE-CENTERED CUBIC LATTICE MgO : LATTICE CONSTANT 4.023×10$^{-1}$nm、CLOSEST INTERATOMIC SPACING 2.845×10$^{-1}$nm

| SUBSTANCE | Ag | Al | Au | Ca | Ce | Cu | Ir | Ni | Pb | Pd | Pr | Pt | Rh | Sc | Th | Yb |
|---|---|---|---|---|---|---|---|---|---|---|---|---|---|---|---|---|
| LATTICE CONSTANT(*10$^{-1}$nm) | 4.086 | 4.050 | 4.078 | 5.570 | 5.150 | 3.615 | 3.839 | 3.524 | 4.950 | 3.890 | 5.151 | 3.924 | 3.804 | 6.060 | 5.084 | 5.479 |
| CLOSEST INTERATOMIC SPACING(*10$^{-1}$nm) | 2.889 | 2.864 | 2.884 | 3.939 | 3.642 | 2.556 | 2.715 | 2.492 | 3.500 | 2.751 | 3.642 | 2.775 | 2.690 | 4.285 | 3.595 | 3.874 |
| MISFIT(%) | 2 | 1 | 1 | 28 | 22 | 11 | 5 | 14 | 19 | 3 | 22 | 3 | 6 | 34 | 21 | 27 |

HEXAGONAL CLOSE-PACKED LATTICE

| SUBSTANCE | Be | Cd | Co | Cp | Dy | Er | Gd | Hf | Ho | La | Mg | Nd | Os | Re | Td | Tc |
|---|---|---|---|---|---|---|---|---|---|---|---|---|---|---|---|---|
| LATTICE CONSTANT(*10 | 2.281 | 2.974 | 2.507 | 3.509 | 3.578 | 3.532 | 3.662 | 3.195 | 3.557 | 3.754 | 3.203 | 3.650 | 2.730 | 2.755 | 3.585 | 2.735 |
| MISFIT(%) | 25 | 4 | 13 | 19 | 20 | 19 | 22 | 11 | 20 | 24 | 11 | 22 | 4 | 3 | 21 | 4 |

| SUBSTANCE | Ti | Tl | Tm | Y | Zn | Zr |
|---|---|---|---|---|---|---|
| LATTICE CONSTANT(*10 | 2.953 | 3.450 | 3.523 | 3.663 | 2.659 | 3.229 |
| MISFIT(%) | 4 | 18 | 19 | 22 | 7 | 12 |

ZINC BLEND STRUCTURE

| SUBSTANCE | ZnS | ZnSe | ZnTe | CdTe | BeS | AlAs | AlP | AlSb | GaAs | GaP | Gasb | InAs | InP | InSb |
|---|---|---|---|---|---|---|---|---|---|---|---|---|---|---|
| LATTICE CONSTANT(*10 | 5.406 | 5.667 | 6.101 | 6.477 | 4.860 | 5.660 | 5.462 | 6.135 | 5.653 | 5.450 | 6.095 | 6.058 | 5.869 | 6.479 |
| CLOSEST INTERATOMIC SPACING(*10$^{-1}$nm) | 3.823 | 4.007 | 4.314 | 4.580 | 3.437 | 4.002 | 3.862 | 4.338 | 3.997 | 3.854 | 4.310 | 4.284 | 4.150 | 4.581 |
| MISFIT(%) | 26 | 29 | 34 | 38 | 17 | 29 | 26 | 34 | 29 | 26 | 34 | 34 | 31 | 38 |

WURTZITE STRUCTURE

| SUBSTANCE | ZnO | BeO | CdS | CdSe | AlN | GaN |
|---|---|---|---|---|---|---|
| LATTICE CONSTANT(*10 | 3.250 | 2.660 | 4.136 | 4.299 | 3.104 | 3.180 |
| MISFIT(%) | 12 | 7 | 31 | 34 | 8 | 11 |

PLASMA DISPLAY PANEL AND PRODUCTION METHOD THEREOF AND PLASMA DISPLAY PANEL DISPLAY UNIT

TECHNICAL FIELD

The present invention relates to plasma display panels, methods of manufacturing the same, and plasma display devices. More specifically, it relates to technology for improving discharge characteristic of the plasma display panels.

BACKGROUND ART

Among color image display devices for computers and television sets, plasma display panels (hereinafter referred to as PDPs) have become a focus of much expectation due to its ability to realize thin display panels. Especially, because a PDP is viewable at wide angles and has excellent characteristics such as rapid response, many companies and research institutes have aggressively pursued development of PDPs toward the popularization of the same.

In such a PDP, a plurality of electrodes are disposed on a front glass substrate and a back glass substrate; the two substrates face each other with a spacing member sandwiched therebetween in such a manner that the electrodes on either substrate are at right angles to the electrodes on the other substrate, and discharge gas is enclosed in the space between the two substrates. A dielectric layer covering the electrodes coats a surface of the front glass substrate that faces the back glass substrate, and further, a protective layer made of MgO coats the dielectric layer.

When driving PDPs, electrical charges are formed on the surface of the protective layer at cells to emit light by performing address discharge between the electrodes on the front and the back glass substrates, and sustained discharge is carried out between electrodes adjacent to the cell, on which the electric charge is formed, on the front glass substrate. The protective layer on which the electric charge is formed is for protecting both the dielectric layer and the electrodes from ion bombardment (sputtering) generated when address discharge and sustained discharge are carried out. The protective layer also has memory function for emitting secondary electron and holding electric charges while address discharge. Therefore, magnesium oxide (MgO) is commonly used for a protective layer because MgO is excellent in both anti-sputtering and secondary electron emission properties.

In recent years, demand for the expansion of life of PDPs has been growing. Japanese Laid-Open Patent Application No. H10-106441 teaches a technique, in which a protective layer is evaporated in an atmosphere containing water vapor, as one solution to meet such a demand. According to H10-106441, the protective layer with (110) plane orientation in a thickness direction of the layer is formed. Because (110) plane orientation results in high anti-sputtering property, erosion of the protective layer is suppressed and it becomes possible to prolong the life of PDPs.

DISCLOSURE OF THE INVENTION

The present invention is made in view of the above circumstance. An object of the present invention is to provide PDPs having a stable discharge characteristic in terms with the driving time and an excellent anti-sputtering property, methods of manufacturing the same, and plasma display devices using the same.

In order to achieve the above object, the plasma display panel according to the present invention is a plasma display panel in which a first panel and a second panel face each other with a spacing member sandwiched therebetween, a plurality of electrodes being disposed in stripes on one of the first and second panels, and a dielectric layer and a protective layer being layered in a stated order so as to cover the plurality of electrodes, wherein the protective layer includes a first layer made of seed crystals and a second layer made of a plurality of columnar crystals, the plurality of columnar crystals growing on the seed crystals, and the first layer is made of one of (i) the seed crystals formed by coalescing a plurality of grain crystals which adhere to the dielectric layer in an initial phase of the first layer formation, and (ii) the seed crystals formed by polycrystallization of an amorphous layer adhered to the dielectric layer in the initial phase of the first layer formation.

In such plasma display panels, in comparison with the conventional art in which material of the protective layer grows on a layer made of grain crystals, the columnar crystals that form the protective layer are made thicker. Since an area of exposed surfaces of the protective layer becomes smaller at large, it is possible to reduce the amount of impurities absorbed in the protective layer. Therefore, it is possible to stabilize the fluctuation in discharge characteristic of plasma display caused by the impurities. In addition, because only few grain crystals remain, the protective layer becomes more close-packed and acquires an excellent anti-sputtering property.

Such protective layers can be made of one of an alkaline earth metal oxide, an alkaline earth metal fluoride, and a mixture of the two, and especially it is preferable that the protective layer is made of MgO having excellent electron emission and anti-sputtering properties, the protective layer has an excellent electron emission property when the protective layer is made of the columnar crystals with (111) plane orientation in a thickness direction.

Further, the plasma display panel according to the present invention is a plasma display panel in which a first panel and a second panel face each other with a spacing member sandwiched therebetween, a plurality of electrodes are disposed in stripes on one of the first and the second panels, a dielectric layer being layered so as to cover the plurality of electrodes, and a protective layer being positioned above the dielectric layer, wherein a middle layer is disposed between the dielectric layer and the protective layer, the middle layer being a base material on which columnar crystals grow so as to form the protective layer.

In such plasma display panels, it is possible to reduce the amount of impurities absorbed in the protective layer, by reducing the area of exposed surfaces of the protective layer at large, because thicker columnar crystals formed on the middle layer in comparison with the conventional art. Accordingly, it is possible to stabilize the fluctuation in discharge characteristic of plasma display caused by the impurities.

Note that when a crystal structure of the middle layer is one of a face-centered cubic structure, a hexagonal close-packed structure, a wurtzite structure, and a zincblende structure, it becomes easier to make the columnar crystals of the protective layer formed thereon thicker in comparison with the conventional art.

Further, specifically, the middle layer is made of one of single crystals, alloyed metal, and compound crystals, the single crystals being made of an element selected from a first element group consisting of Ag, Al, Au, Be, Cd, Co, Cu, Ga, Hf, In, Ir, Mg, Ni, Os, Pd, Pt, Re, Rh, Tc, Ti, Zn, and Zr, the alloyed metal being made of at least two elements selected from the first element group, and the compound crystals being made of at least one element selected from the first element group and at least one element selected from a second element group consisting of As, N, O, P, S, Sb, Se, and Te.

In order to make the middle layer desirable to make the columnar crystals thicker, it is preferable that a misfit of a substance of the middle layer to a substance of the protective layer is around 15% or lower.

Note that when the columnar crystals which form the protective layer is made of MgO having (111) plane orientation in a thickness direction, the columnar crystals form the protective layer having excellent electron emission property.

Further, the plasma display panel according to the present invention is a plasma display panel in which a first panel and a second panel face each other with a spacing member sandwiched there between, a plurality of electrodes being disposed in stripes on one of the first and second panels, and a dielectric layer and a protective layer being layered in a stated order so as to cover the plurality of electrodes, wherein the dielectric layer having grooves on one of main surfaces of the dielectric layer that faces the protective layer, the grooves being for forming the protective layer single-crystal-like.

In such plasma display panels, the protective layer is formed single-crystal-like, in other words, the columnar crystals forming the protective layer becomes thicker in comparison with the conventional art. Therefore, it is possible to stabilize the discharge characteristic of PDPs, because the amount of impurities absorbed in the protective layer is reduced in comparison with the conventional art.

It is confirmed that an entire protective layer can be made single-crystal-like by forming the grooves in parallel stripes, and that the protective layer becomes single-crystal-like when width of the groove is within a range of 160 to 3800 nm inclusive.

It is preferable that the protective layer has either (100) or (111) plane orientation in a thickness direction, and is made of MgO having excellent electron emission and anti-sputtering properties.

Plasma display devices using plasma display panels described above are excellent in both anti-sputtering property and discharge characteristic.

The method for manufacturing plasma display panel according to the present invention is a method for manufacturing a plasma display panel in which a panel formation process having a first step for forming electrodes on a substrate, a second step for forming a dielectric layer so as to cover the electrodes, and a third step for forming a protective layer coating the dielectric layer, wherein the third step comprises: a material adhering step for adhering material of the protective layer to the dielectric layer; a heat treatment step for heat treating the material of the protective layer and forming seed crystals; and a protective layer forming step in which the material of the protective layer grows on the seed crystals.

MgO that is commonly used for the protective layer has a rocksalt structure (sodium chloride structure) with a strong ion crystallinity. Thus, in theory, a surface of the protective layer made of MgO has (100) plane orientation when formed on the amorphous dielectric layer. However, the surface of the protective layer has (111) plane orientation in practice, and it is considered that the fluctuation in the orientation plane is caused. It is probable that the columnar crystals made of MgO have crystal defects due to discontinuity in the orientation. Accordingly, MgO is susceptible to forming the protective layer having the thinner columnar crystals, the larger exposed surfaces, and the greater amount of absorbed impurity gas.

However, according to the above described method for manufacturing, it is possible to make the columnar crystals thicker in comparison with the conventional art. Accordingly, the exposed surfaces and the amount of impurities can be reduced. Thus, it is possible to stabilize the discharge characteristic of PDPs.

When the grain crystals are adhered in the material adhering step, it is possible to make the columnar crystals thicker coalescing the plurality of grain crystals, by heating up to a temperature of melting point of the grain crystal T (K) or higher in the heat treatment step. In a case where an amorphous layer adhered in the material adhering step, the amorphous layer can be heated up at relatively low temperature in the heat treatment step, because the amorphous layer crystallizes at ⅔ of melting point of the amorphous layer T (K) or higher.

Specifically, in the heat treatment step, the heat treatment can be carried out by irradiating an energy beam to the material of the protective layer. An apparatus for emitting the energy beam can be one of a laser irradiating unit, a lamp irradiating unit, and an ion irradiating unit.

In addition, it is possible to suppress the oxygen defect in the protective layer by carrying out the heat treatment step in reduced-pressure atmosphere containing oxygen.

It is possible to suppress the absorption of impurities such as water in forming of the protective layer and to stabilize the discharge characteristic of the PDPs, by carrying out processes without exposure to air during a period from the material adhering step through the protective layer forming step, or a period from the heat treatment step through the protective layer forming step. In addition, by carrying out the material adhering step and the heat treatment step at the same time, it is possible to keep the surface of the material of the protective layer adhered activated, and thus to make the size of the seed crystals greater. Moreover, it is preferable that the seed crystals are kept at a room temperature or higher, because epitaxy occurs easily and the crystallinity of the protective layer improves in a case where the seed crystals are kept activated from the heat treatment step to the protective layer forming step.

The method for manufacturing plasma display device according to the present invention is a method of manufacturing a plasma display panel in which a panel formation process having a first step for forming electrodes on a substrate, a second step for forming a dielectric layer so as to cover the electrodes, and a third step for forming a protective layer above the dielectric layer, wherein the panel formation process further comprises a fourth step between the second and the third steps, for coating a middle layer over the dielectric layer, the middle layer being a base material on which the material of the protective layer grow into columnar crystals.

According to such a manufacturing method, the columnar crystals of the protective layer can be formed thicker without performing the heat treatment described above and the discharge characteristic of the PDPs becomes stabilized in comparison with the conventional art.

In the third step, by evaporating the material of the protective layer in reduced-pressure atmosphere containing oxygen, it becomes possible to make the thicker columnar crystals forming the protective layer. In addition, it is desirable to coat the middle layer in reduced-pressure atmosphere in the fourth step. Depending on material used for the middle layer, it is preferable in some cases to carry out the process in reduced-pressure atmosphere containing $N_2$.

Moreover, by carrying out processes without opening the air during a period from the fourth step through an end of the third step, it is possible to suppress the adhesion of impurities to the protective layer formation, and thus to stabilize the discharge property of the PDPs.

The method for manufacturing plasma display panel according to the present invention is a method for manufacturing a plasma display panel in which a panel formation process having a first step for forming electrodes on a substrate, a second step for forming a dielectric layer so as to cover the electrodes, and a third step for forming a protective layer coating the dielectric layer, wherein the second step comprises: a dielectric layer coating step for coating material of the dielectric layer over the electrodes formed in the first step; and a groove forming step for forming grooves on the surface of the dielectric layer, the material of protective layer growing into single-crystal-like on the grooves.

According to this method, it is possible to form the protective layer single-crystal-like. Therefore, in comparison with the conventional art, the area of exposed surfaces of the protective layer is reduced and the amount of impurities absorbed in the protective layer decreases. Thus, it is possible to stabilize the discharge characteristic of the plasma display panels.

Specifically, in the groove forming step, the grooves are formed by a method which is one of a machine cutting method, a chemical etching method, and an excimer laser method.

Further, it is possible to form the protective layer single-crystal-like, by the third step comprises: a material adhering step for adhering a plurality of grain crystals to the dielectric layer, the plurality of grain crystals being made of material of the protective layer; a heat treatment step for heating and coalescing the plurality of grain crystals adhered in the material adhering step; and a protective layer forming step in which the material of the protective layer grows on the plurality of grain crystals that are coalesced in the heat treatment step.

In the heat treatment step, when the grain crystals are adhered in the material adhering step, the grain crystals are heated up to a temperature of melting point of the grain crystal T (K) or higher. When the amorphous layer is adhered in the material adhering step, the amorphous layer is heated up to a temperature of ⅔ of melting point of the amorphous layer T (K) or higher.

Specifically, in the heat treatment step, the heat treatment is carried out by irradiating an energy beam to the material of the protective layer, and an apparatus for emitting the energy beam can be one of a laser irradiating unit, a lamp irradiating unit, and an ion irradiating unit.

It is possible to suppress the oxygen defect by carrying out the heat treatment step in reduced-pressure atmosphere containing oxygen.

In addition, by carrying out the material adhering step and the heat treatment step at the same time, it is also possible to keep the surface of the material of the protective layer adhered active, and to make the size of the seed crystals larger.

Further, by carrying out processes in reduced-pressure atmosphere or without opening the air during a period from the heat treatment step through the protective layer forming step, it is possible to suppress the adhesion of impurities and stabilize the discharge characteristic of PDPs. Moreover, by carrying out processes without exposure to air during a period from the material adhering step through the protective layer forming step, it is possible to further reduce the amount of impurities absorbed in the protective layer, and the discharge characteristic of the PDPs can be made further stabilized.

In addition, because epitaxy can be caused easily and the crystallinity of the protective layer can be improved when the seed crystals are active from the heat treatment step to the protective layer forming step, it is preferable that the seed crystals are kept at a room temperature or higher during a period from the heat treatment step through the protective layer forming step.

BRIEF DESCRIPTION OF THE DRAWINGS

FIG. 10 is a table of values calculated the lattice constant and misfit to MgO of substances that can be used for a middle layer.

BEST MODE FOR CARRYING OUT THE INVENTION

First Embodiment

An explanation about a PDP and a Plasma display device according to the first embodiment is given with reference to drawings.

[The Construction of PDP 10]

Figure 1:
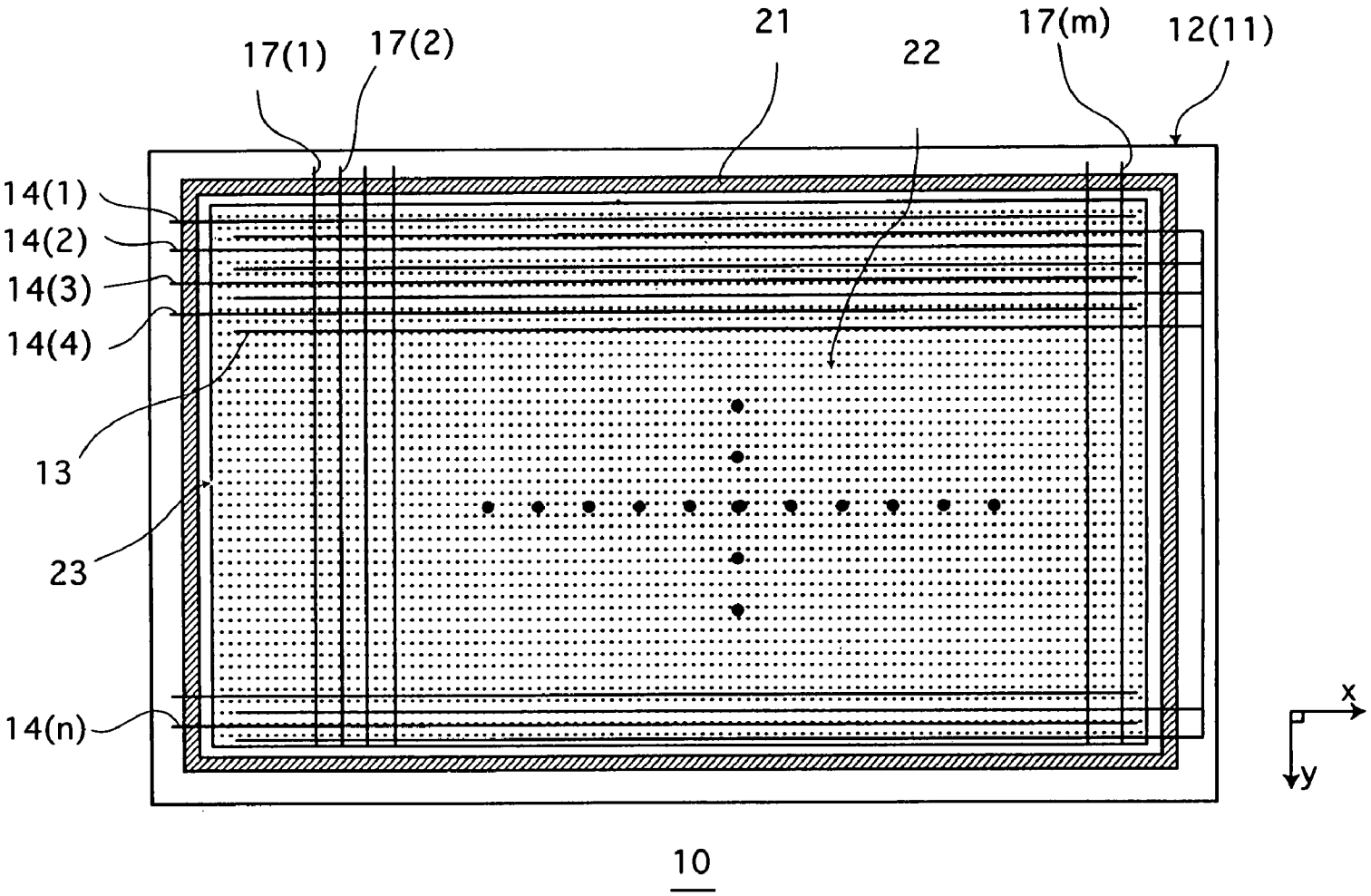
FIG. 1 is a plane view of a PDP according to the first embodiment, with a front glass substrate removed.
Figure 2:
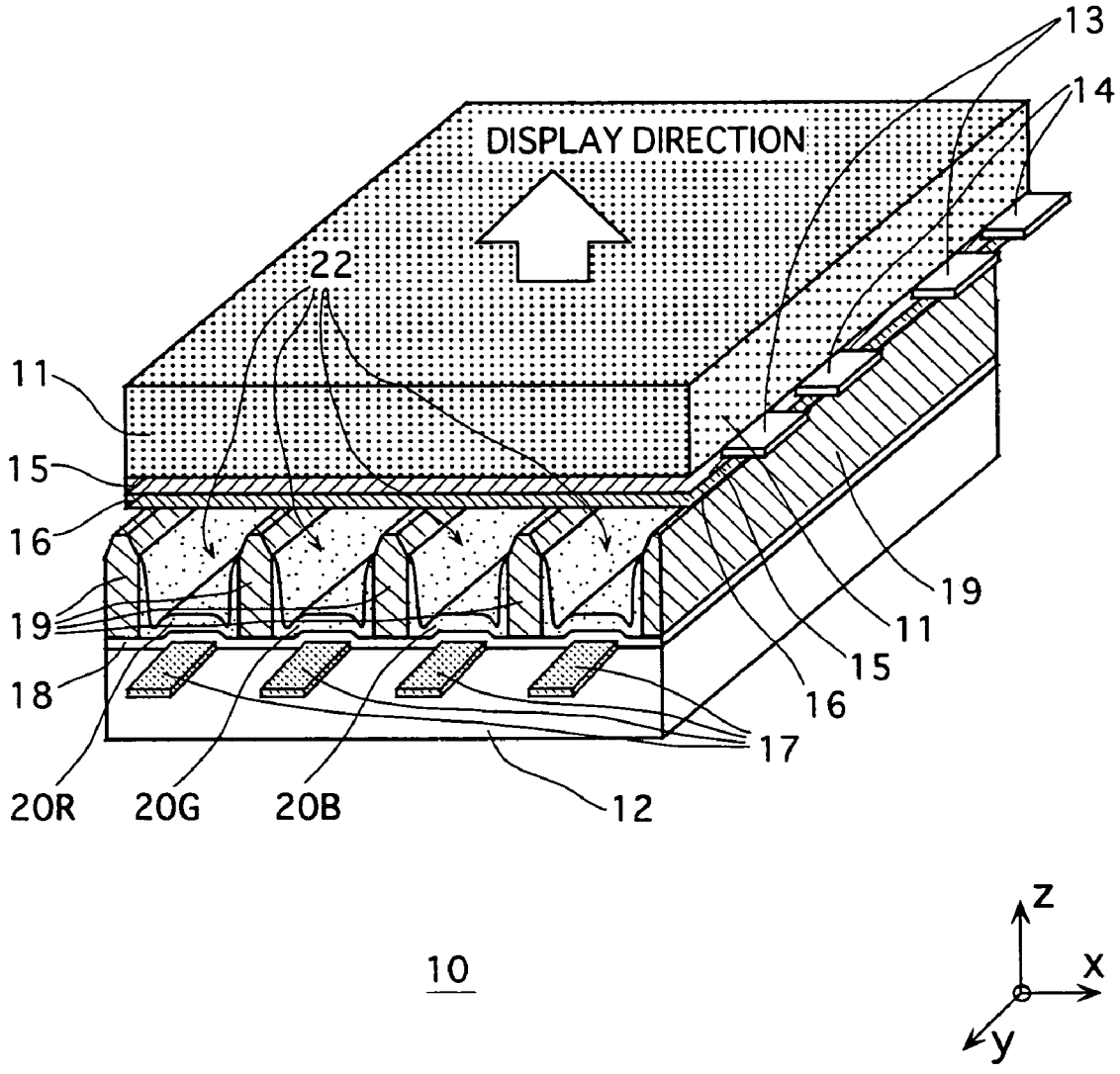
FIG. 2 is a perspective view schematically showing a part of the PDP of FIG. 1.

FIG. 1 is a plane view of a PDP 10, with a front glass substrate 11 removed, and FIG. 2 is a perspective view schematically showing a part of the PDP 10. Note that a part of display electrodes 13, display scanning electrodes 14, and address electrodes 17 are not shown in FIG. 1 for the purpose of explanation. An explanation about a construction of the PDP 10 is given with reference to the two drawings.

As shown in FIG. 1, the PDP 10 comprises the front glass substrate 11 (not shown in FIG. 1), a back glass substrate 12, the (n) display electrodes 13, the (n) display scanning electrodes 14, the (m) address electrodes 17, and a hermetic sealing layer 21 which is shown by hatched lines. The electrodes 13, 14, and 17 form an electrodes matrix having a three-electrode-structure so as to form cells on each intersection of the display electrodes 13, the display scanning electrodes 14, and the address electrodes 17.

As shown in FIG. 2, the PDP 10 has a construction wherein the glass substrate 11 as a front panel and the back glass substrate 12 as a back panel are positioned in parallel with barrier ribs that are disposed in stripes between the two panels.

The front panel includes the display electrodes 13, the display scanning electrodes 14, a dielectric layer 15, and a protective layer 16, all of which are formed on one of main surfaces of the front glass substrate 11.

The display electrodes 13 and the display scanning electrodes 14, both made of conductive material such as silver, are formed by turn in parallel lines on the front glass substrate 11.

The dielectric layer 15, made of a substance such as lead glass, is formed so as to cover the front glass substrate 11, the display electrodes 13, and the display scanning electrodes 14.

The protective layer 16, made of magnesium oxide (MgO) having (111) plane orientation that is excellent in both anti-sputtering and secondary electron emission properties, coats a surface of the dielectric layer 15. Examples of substances that comprise the protective layer include oxide and fluoride of alkaline earth metals (Be, Mg, Ca, Sr, Ba, and Ra) that has the electron emission property, and a mixture of the above that could be formed into crystals.

The back panel includes the address electrodes 17, a base dielectric layer 18, barrier ribs 19, and phosphor layers 20R, 20G, and 20B, all of which are formed on one of main surfaces of the back glass substrate 12.

The address electrodes 17 are disposed parallel to each other on the back glass substrate 12, and made of conductive material such as silver.

The base dielectric layer 18 is formed so as to coat the address electrodes 17, and made of dielectric glass containing titanium oxide, for instance. The base dielectric layer 18 is for reflecting visible light emitted from each of the phosphor layers 20R, 20G, and 20B, in addition to a function as a dielectric layer.

The barrier ribs 19 are disposed on the surface of the based dielectric layer 18, and in parallel to the address electrodes 17. The phosphor layers 20R, 20G, and 20B are formed in an order in concave potions between two of the barrier ribs 19 as well as on side walls of the barrier ribs 19.

The phosphor layers 20R, 20G, and 20B are layers, to each of which phosphor particles emitting Red, Green, and Blue light respectively are adhered.

The PDP 10 has such a construction that the front panel and the back panel explained above are sealed together at a circumference part of the panels with the hermetic sealing layer 21, with discharge gas (a mixed gas of 95 vol % of neon and 5 vol % of xenon, for instance) is enclosed at predetermined pressure (around 66.5 kPa, for instance).

Figure 3:
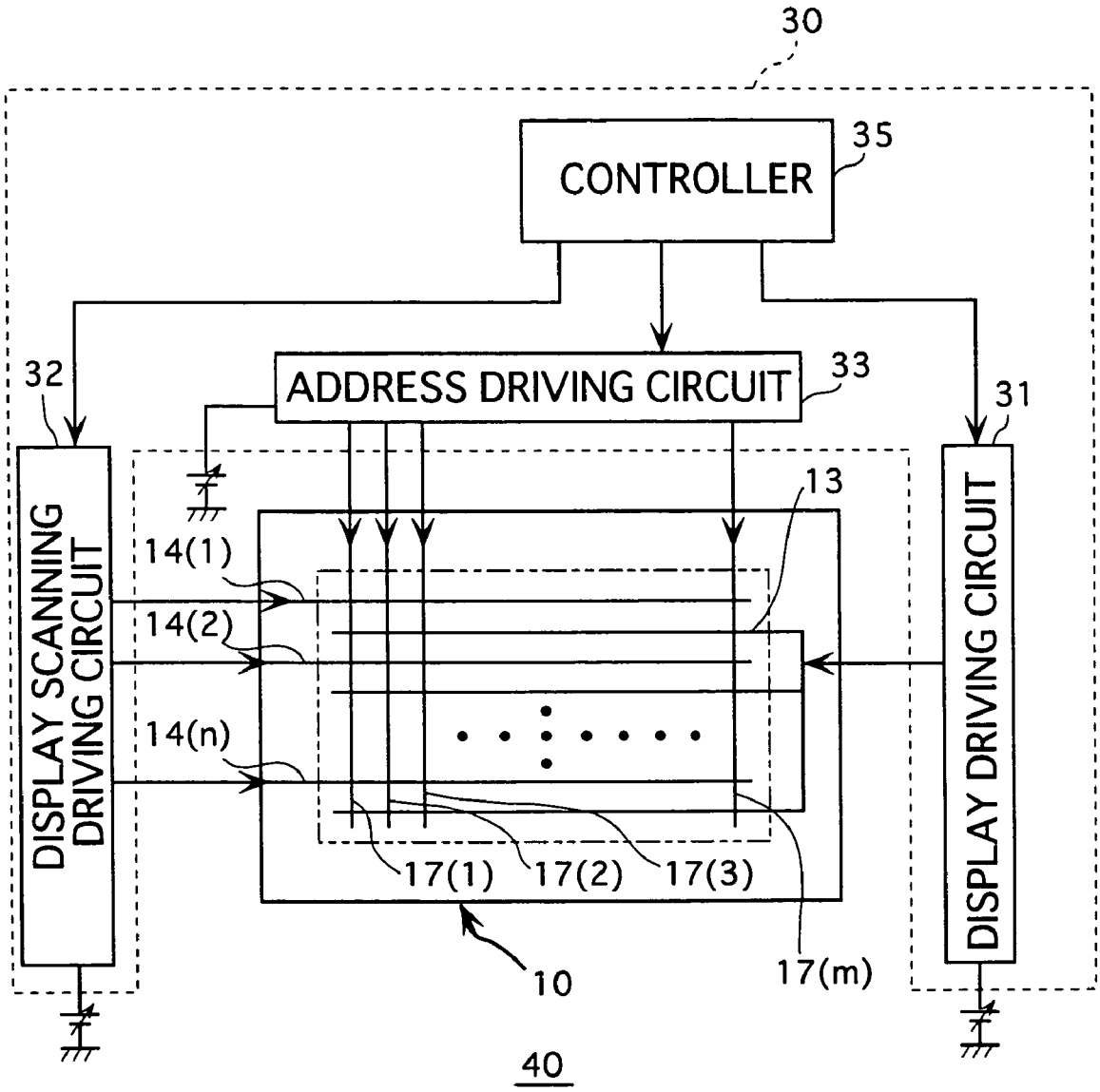
FIG. 3 shows a construction of a Plasma display device according to the first embodiment.

FIG. 3 shows a construction of a plasma display device 40.

The plasma display device 40 comprises the PDP 10 and a PDP driving unit 30, wherein the PDP 10 is connected to the PDP driving unit 30.

The PDP driving unit 30 comprises a display driving circuit 31 connected to and drives the display electrodes 13 of the PDP 10, a display scanning driving circuit 32 connected to and drives the display scanning electrodes 14, an address driving circuit 33 connected to and drives the address electrodes 17, and a controller 34 for controlling the driving circuits 31, 32, and 33.

When driving the plasma display device 40, under the control of the controller 34, a voltage greater than the voltage at the beginning of discharge is applied to the display scanning electrodes 14 and the address electrodes 17 at the cells to emit light. By this, address discharge between the display scanning electrodes 14 and the address electrodes 17 is carried out and wall charges are formed. Then, by applying pulse voltage to the display electrodes 13 and the display scanning electrodes 14 both at once, sustained discharge is carried out at the cells on which the wall charges are formed. While performing the sustained discharge, ultraviolet ray is generated from the discharge gas in a discharge space 22 (FIG. 2). The cells light when the phosphor layers 20R, 20G, 20B (FIG. 2) emit light being excited by the ultraviolet ray, and the images are displayed as combinations of on/off of each color of phosphor layers.

[Construction of Front Panel]

[Conventional Front Panel]

Before explaining about the protective layer which is the main characteristics of the present invention, the explanation about the protective layer of the conventional front panel is given first.

Figure 4:
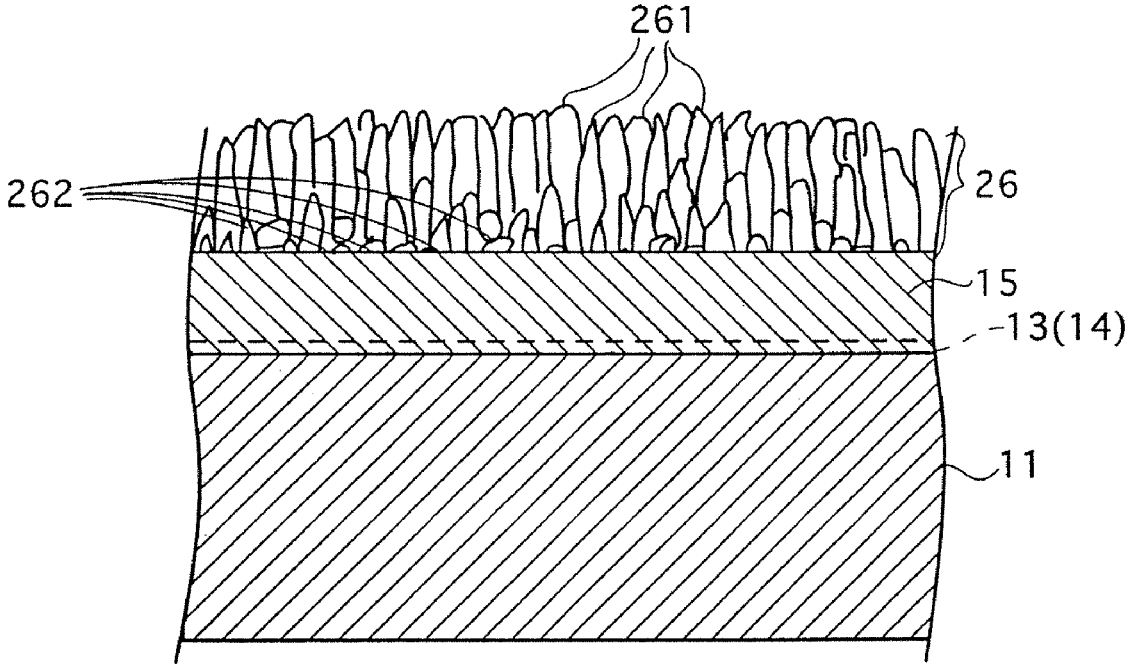
FIG.4 PRIOR ART
FIG. 4 is a sectional view of the main part of a front panel of a conventional PDP.

FIG. 4 is a sectional view of the main part of a front panel of a conventional PDP. Note that the conventional front panel has a similar construction with the front panel explained above with reference to FIGS. 1-3, and is only different in the construction of the of the protective layer 26. Therefore, explanations about the members having the same numbers are not given.

As shown in the FIG. 4, the conventional front panel has such a construction that a dielectric layer 15 is layered on a front glass substrate 11 so as to cover display electrodes 13, display scanning electrodes 14, and a protective layer 26 is formed on the dielectric layer 15.

The protective layer 26 comprises two layers: a layer made of columnar crystals 261 (about 15 nm in width) which extend vertically to a surface of the dielectric layer 15, and another layer made of grain crystals 262 adhered on the surface of the dielectric layer 15. The two layers are formed by coating MgO over the dielectric layer 15 by vacuum evaporation. The columnar crystals 261 are formed on the grain crystals 262, which is called a dead layer. Accordingly, the columnar crystals 261 do not grow thick, and it is considered that an exposed surface becomes relatively large because the grain crystals 262 exist, and it is highly possible that impurities such as water adsorbed in the exposed surface of the columnar crystals 261. Therefore, the protective layer 26 can easily contain impurities such as water.

Such impurity gases, especially water, have adverse effects to the discharge characteristic of PDPs. More specifically, when driving a PDP, impurities such as water are eventually discharged from crystal boundaries of the protective layer 26 activated by plasma sputtering. Accordingly, as the moisture increases in the discharge space, the higher voltage becomes required for address discharge, and the cells become more susceptible to failure in emitting light even when the address discharge is carried out. Thus, it is considered that the discharge characteristic of the PDP becomes unstable.

To improve the discharge characteristic, it is expected to broaden the grain diameter of the columnar crystals 261 as well as to reduce the exposed surface of the columnar crystals 261 by suppressing the generation of the grain crystals 262. A method of increasing the temperature during evaporation is considered to be one solution. However, not only that this method still has a limit in broadening the diameter of the columnar crystals, but that the grain crystals cannot be suppressed completely. Moreover, in a case where the temperature of the front panel becomes 350° C. or above, it becomes difficult to obtain a protective layer having a stoichiometrical composition as well as to stabilize the discharge characteristic of a PDP.

In addition, because the diameter of the columnar crystals 261 in protective layer 26 are small, the protective layer 26 becomes less close-packed in a case where the grain crystals 262 exist. Accordingly, it is considered that the protective layer 26 is not very excellent in anti-sputtering property, and that there is still much room for improvement.

[Front Panel of the Present Invention]

The explanation about a front panel, which characterizes PDPs according to this embodiment, is given in the following.

Figure 5:
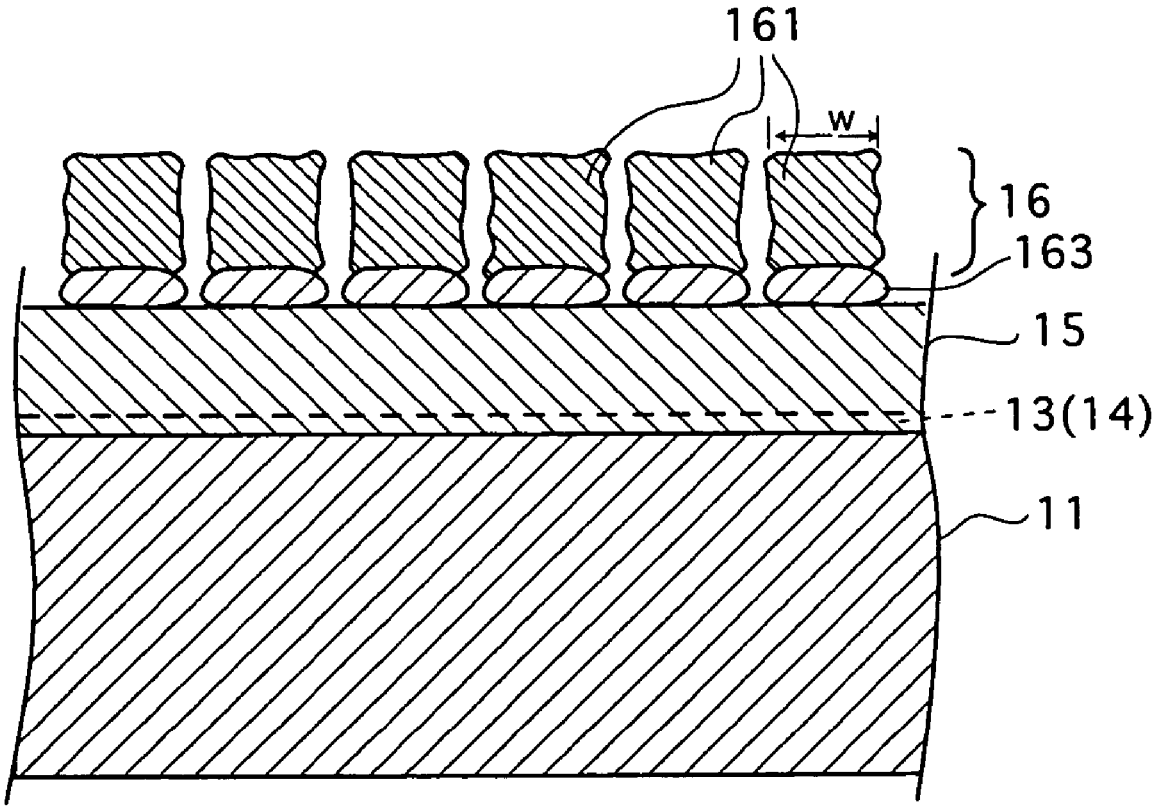
FIG. 5 is a sectional view of the main part of a front panel of the PDP of FIG. 2, viewing along y-axial direction.

FIG. 5 is a sectional view of the main part of the front panel of the PDP of this embodiment.

As shown in FIG. 5, on the front panel, the dielectric layer 15 is layered on one of main surfaces of the front glass substrate 11 so as to cover the display electrodes 13 and the display scanning electrodes 14, and the protective layer 16 formed on the dielectric layer.

The protective layer 16 comprises two layers: a layer made of seed crystals 163, and another layer made of a plurality of columnar crystals 161 (which is in (111) plane orientation in a thickness direction of the protective layer 16), growing on the seed crystals 161 as a base material and extending toward the vertical direction to a surface of the dielectric layer 15. A dead layer made of grain crystals found in the conventional protective layers are not formed.

The seed crystals 163 works as a base material for enhancing the crystal orientation of the columnar crystals 161 which are formed on the seed crystals 161. While, because the both crystals are made of the same MgO, it is hard to distinguish the seed crystals 163 from the columnar crystals 161, the seed crystals 163 are formed in thickness of around 200 nm.

On the other hand, width W of the columnar crystals 161 is about 30-45 nm, which makes the columnar crystals 161 twice or thrice thicker than the conventional columnar crystals (15 nm). Accordingly, an exposed surface of the protective layer 16 is reduced in comparison with the conventional protective layer 26 (FIG. 4). In addition, the protective layer 16 does not include the grain crystals 262 (FIG. 4). Therefore, an exposed surface of the columnar crystals 161 is also reduced. Also, because the amount of impurities absorbed in the protective layer 16 decreases in comparison with the conventional protective layer 26, the amount of impurities discharged during the sustained discharge decreases as well. Thus, the discharge characteristic becomes stable. In addition, a dead layer is not formed in the protective layer 16 and the columnar crystals are formed thick, the protective layer becomes more close-packed and obtains improved anti-sputtering property.

[Method for Manufacturing PDP 10]

Next, a method for manufacturing the PDP 10 described above is explained below.

FIGS. 6A-6E are sectional views of the main part of the front panel, each showing each manufacturing step proceeding in an alphabetic order.

(1) Manufacturing the Front Panel:

The front panel is manufactured in a following manner; first, the (n) display electrodes 13 and the (n) display scanning electrodes 14 are formed by turn in parallel lines on the front glass substrate 11, next, the dielectric layer 15 cover the display electrodes 13 and the display scanning electrodes 14, and finally, the protective layer 16 is formed on the surface of the dielectric layer 15.

Figure 6A:
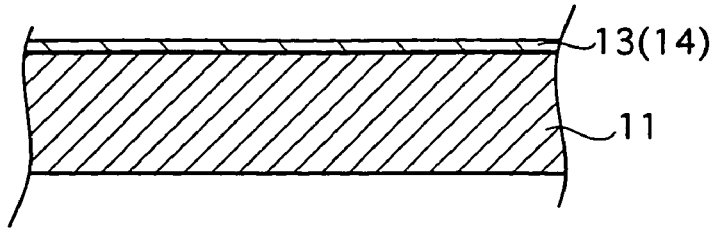
FIGS. 6A-6E are sectional views of the main part of the front panel according to the first embodiment, each showing each manufacturing step proceeding in an alphabetic order.

The display electrodes 13 and the display scanning electrodes 14, each made of silver for instance, are formed as shown in FIG. 6A by burning silver paste for electrodes applied to the front glass substrate 11 in a predetermined interval (around 80 μm, for instance) using screen printing.

Figure 6B:
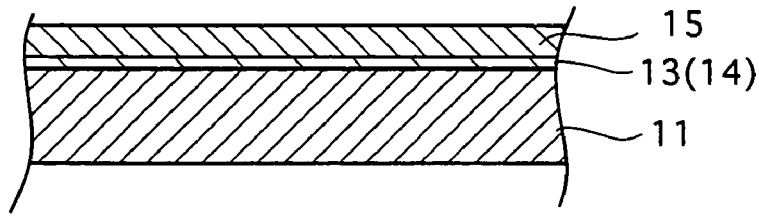

Then, the dielectric layer 15 as shown in FIG. 6B is formed in around 20 μm in thickness by burning after drying a paste containing lead monoxide (PbO) which is applied using screen printing.

Finally, a method of formation of the protective layer which is characteristic to this embodiment is explained below.

Figure 6C:
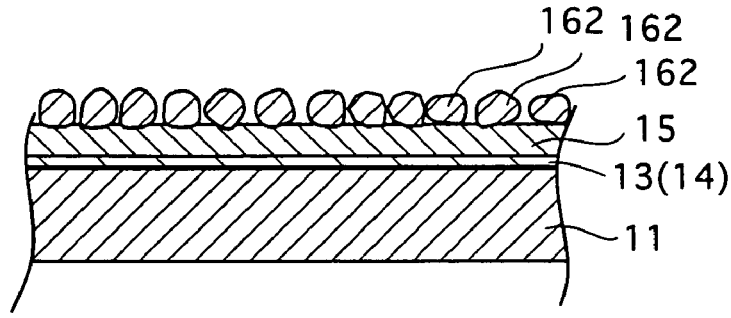

As shown in FIG. 6C, using vacuum evaporation such as EB evaporation, the grain crystals 162 made of protective layer material are adhered to the surface of the dielectric layer until the thickness of the protective layer becomes about 200 nm for instance. In an early stage of the evaporation, a substance to form the protective layer adhered on the dielectric layer can be separated easily, and therefore only crystals with a small diameter such as grain crystals 162 can be formed. Note that, while it is not shown in the drawings, a layer made of amorphous can be formed instead of the grain crystals 162.

Figure 6D:
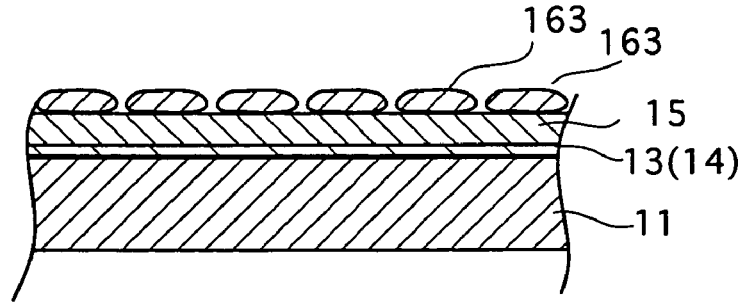

Next, heat treatment is carried out to the grain crystals 162 adhered in the above manner, without opening the air in order to prevent water from adhering. By doing so, the grain crystals 162 adjacent to each other are coalesced and the seed crystals 163 having a greater diameter than the grain crystals 162 are formed as shown in FIG. 6D. In a case where the amorphous layer is formed as noted above, the heat treatment causes polycrystallization, and the seed crystals are formed within the surface of the amorphous layer. In the heat treatment step, devices used for the heat treatment include a laser irradiation device such as Argon laser, a heat lamp irradiation device, or an ion irradiation device, and it is preferable to use a heating method wherein irradiation is carried out while the front panel is relatively moved against a converged energy beam emitted from an irradiation device. This is because while strain could occur to the front glass substrate if the entire front panel is heated up to near 1273 K, such problems can be suppressed by heating the substrate by a beam like a spotlight, and the treatment can be carried out with less energy.

A brief explanation about the heat treatment is given below. Irradiating a laser beam to the surface of the grain crystals 162 creates electrons and holes having a high energy and excites lattice vibration. The electrons and holes are recombined losing energy as they emit phonon. In the process, the temperature rises, and each of the grain crystals 162 melts and is coalesced with the adjacent grain crystals 162. When the laser irradiation ceased, the molten grain crystals 162 re-crystallize. By such re-crystallization, the seed crystals having an expanded diameter after coalescing the plural grain crystals together are formed. The seed crystals 163 have a single crystal structure of MgO with (111) plane orientation in a thickness direction.

The heat treatment on the grain crystals 162 is carried out at a temperature higher than 1273 K, which is the crystal melting point of the substance. Therefore, it is preferable that a pulse laser which can irradiate a laser beam at a high temperature for a short period of time (nsec order). Note that the heat treatment can be carried out at a lower temperature in a case of the amorphous layer, because the amorphous layer is molten at a temperature lower than the crystal melting point T (K) (⅔T (K) or above) of the substance.

When the heat treatment is carried out in a reduced-pressure atmosphere, the amount of thermal energy absorbed by gas is suppressed. Further, when the heat treatment is carried out in a reduced-pressure atmosphere containing oxygen, the oxygen defect decreases and re-crystallization is carried out selectively to form crystals in (111) plane orientation having an excellent electron emission property. Thus, it is preferable to carry out the heat treatment under such conditions. In addition, simultaneously carrying out the heat treatment and a treatment for adhering protective layer material on the surface of the dielectric layer 15 improves the effect of the treatment, because the heat treatment is carried out while a surface of protective layer material adhered is active.

Figure 6E:
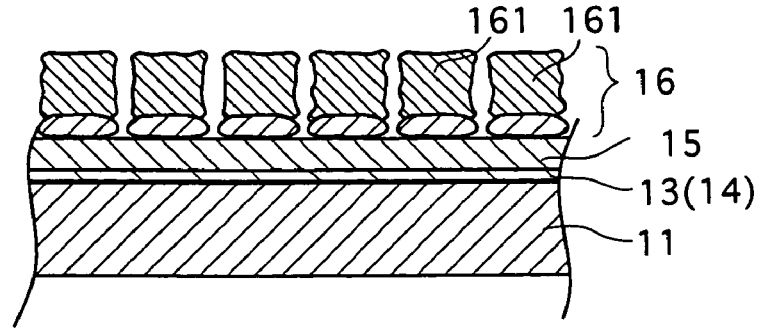

As explained above, because the seed crystals 163 are single crystals in plane orientation, crystal growth (in (111) plane orientation in a thickness direction of the protective layer 16) based on the seed crystals as base material can be easily caused. Accordingly, as shown in FIG. 6E, by carrying out vacuum evaporation again to the seed crystals 163 until the thickness of the entire protective layer becomes 1000 nm, it is possible to obtain the columnar crystals 161 that are thicker than the conventional columnar crystals 261 (FIG. 4), without leaving any grain crystals. It is preferable to keep the temperature of the front panel on which the seed crystals 163 at a room temperature or higher, because it becomes easier to cause the crystal growth when the seed crystals are maintained in the active state after the heat treatment.

Note that in a case where the above mentioned vacuum evaporation is employed, it is preferable to perform the treatment in a reduced-pressure atmosphere containing oxygen. The oxygen contained in atmosphere suppress the oxygen defect in the crystal structure of the substance evaporated. In addition, by not opening atmosphere of the front panel during periods from the EB evaporation through the heat treatment, from the heat treatment through the EB evaporation, and entirely through the above periods, it is possible to suppress the absorption of water (impurities) in the atmosphere to the protective layer 16, and it is preferable in terms of stabilizing the PDP discharge characteristic.

(2) Manufacturing the Back Panel:

Next, an example of methods of manufacturing back panels is explained below with reference to FIGS. 1 and 2.

The back panel is manufactured in a following manner; first, the (m) address electrodes 17 are formed in parallel lines on the back glass substrate 12 by burning silver paste for electrodes applied to the back glass substrate 12 using screen printing. Next, the base dielectric layer 18 is formed by applying a paste containing $TiO_2$ particles and dielectric glass material by screen printing. Then, the barrier ribs are formed by burning a paste containing the same dielectric glass material after applying the paste in a predetermined interval using screen printing. The discharge space 22 is sectioned by cells (unit area for light emission) in x axis direction.

In the grooves between the adjacent barrier ribs 19, phosphor inks in paste form are applied. Each of the phosphor inks contains organic binders, and one of red (R), green (G), or blue (B) phosphor particles. By burning at a temperature from 400 to 590° C. and consuming the organic binders, the phosphor layers 20R, 20G, and 20B made of phosphor particles bound together are formed.

(3) Manufacturing PDP by Sealing Panels Together:

The front panel and the back panel manufactured as explained in the above are sealed together in such a manner that the electrodes on the front panel are at right angles to the address electrodes on the back panel. Next, the two panels are sealed by forming the a hermetic sealing layer 21 (FIG. 1) by burning a glass for sealing interposed between circumference parts of the panels for 10 to 20 minutes at around 450° C. Then, after exhausting gas so as to make the discharging space 22 high vacuum ($1.1\times10^{-4}$ Pa, for instance), a discharge gas (an inert gas such as He—Xe type and Ne—Xe type for example) is enclosed at a predetermined pressure (66.5 kpa, for instance), and thus the PDP 10 is manufactured.

[Effect]

In the first embodiment as have been explained above, in forming the protective layer 16, the seed crystals 163 having larger diameter and being mono-crystallized are formed first, by carrying out the heat treatment after the grain crystals 162 are adhered by vacuum evaporation. Next, by carrying out vacuum evaporation to the seed crystals 163, the columnar crystals 161, having greater diameter in comparison with the conventional art, are formed, and a dead layer made of the grain crystals becomes difficult to be formed. Thus, it is possible to obtain the protective layer having excellent anti-sputtering property and stable discharge characteristic.

More specifically, the protective layer obtained in a manner described above is a layer in which the columnar crystals 161 having excellent mono-crystallinity are closely packed. Accordingly, the protective layer 16 becomes more close-packed in comparison with the conventional art, and therefore it is considered that the anti-sputtering property of the protective layer becomes better in comparison with the conventional art. In addition, the columnar crystals 161 forming the protective layer 16 are formed thicker in comparison with the conventional art. It is considered that the discharge characteristic in PDP can be made stable, because the exposed surface of the entire protective layer is reduced and the amount of impurities absorbed in the protective layer decreases.

In the above explained embodiment, the grain crystals made of MgO as protective layer material are formed using vacuum evaporation and then the heat treatment is carried out to the grain crystals to form the seed crystals. However, in the step for adhering the protective layer material, it is also possible to obtain the same effect by using a vapor phase growth method, instead of a spin-coat method in reduced-pressure atmosphere such as vacuum evaporation, for applying a paste containing MgO and carry out the heat treatment to the paste. By employing such a method, the protective layer material can be applied much more easily.

EXAMPLE

(1) Sample S1 of Example

By using an EB evaporation method explained above, a protective layer (100 nm) made of MgO was formed. After carrying out the heat treatment, a front panel was formed by growing the protective layer made of MgO to 1000 nm by EB evaporation. A plasma display panel manufactured using the above front panel was taken as a sample of an example here. Note that a discharge gas was a mixture with 95 vol % of Ne and 5 vol % of Xe, and the charged pressure was 66.5 kPa.

(2) Sample R1 of Comparison Example

A plasma display panel using a front panel formed by a conventional method for forming a protective layer was taken as a sample of a comparison example. Note that the thickness of the protective layer, the discharge gas, and the charged pressure of the sample of the comparison example were the same as the sample of the example.

(3) Experiment

Method of Experiment:

The PDP driving circuit 30 explained above in the FIG. 3 was connected to each of the sample of the example S1 and the sample of the comparison example R1, then white light is displayed successively on a whole display, and the address voltage (Vdata) to the driving time was measured. The address voltage is the voltage applied to the address electrodes to select the discharge cell to display, and, in the experiment, specifically means the minimum voltage required for causing the address discharge.

(4) Results and Thoughts

Figure 7:
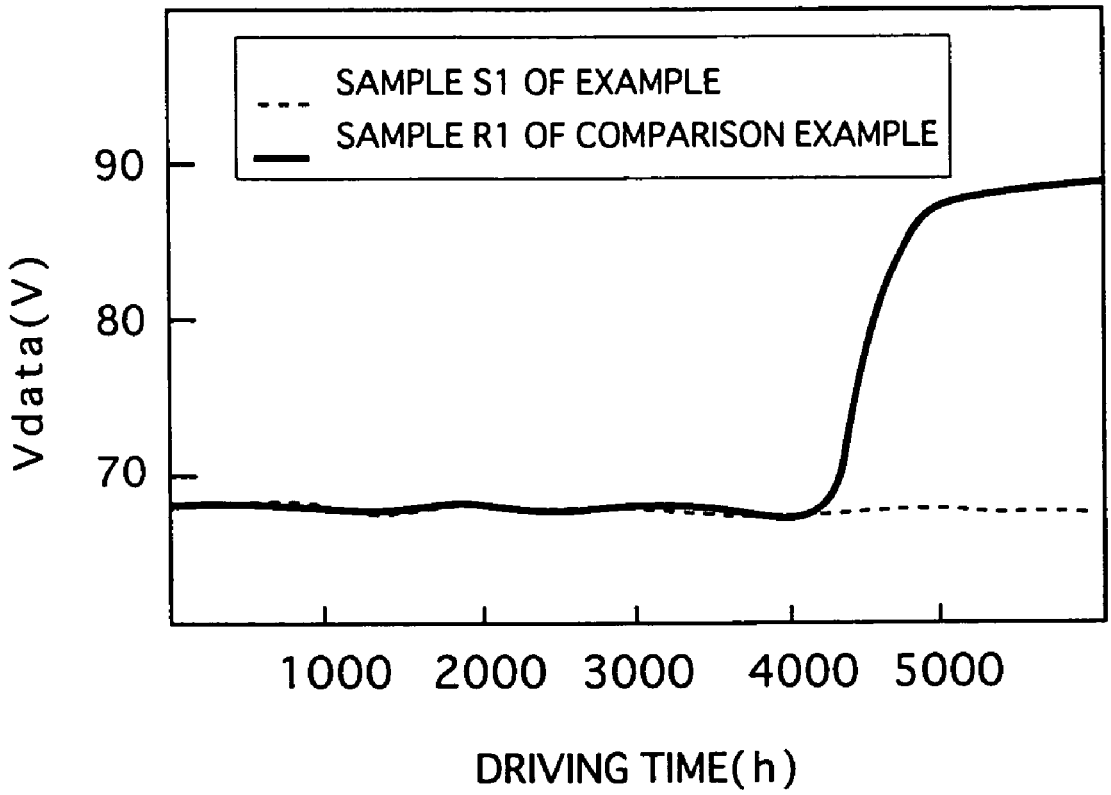
FIG. 7 is a graph plotting the address voltage to the driving time of the PDP of the present invention and the conventional PDP.

The results of the experiment are shown in FIG. 7.

FIG. 7 is a graph plotting the address voltage (Vdata) to the driving time of the sample of the example S1 and the sample of the comparison example R1.

As shown in FIG. 7, while the address voltage (Vdata) to the driving time of the sample of the comparison example R1 rises drastically when the driving time exceeds 4000 hours, the address voltage (Vdata) to the driving time of the sample of the example S1 is substantially stable. The reason of this is considered to be as follows. In the sample of the example S1, by performing the heat treatment during the process of the protective layer formation, the columnar crystals are formed thicker and the exposed surface of the entire protective layer decreases. Accordingly impurities such as water are not easily absorbed in the protective layer and the amount of impurities discharged during driving time is reduced in comparison with the conventional art.

Second Embodiment

Now, an explanation about a PDP and a PDP display of the second embodiment as one example of application of the present invention is given below. Note that the structures of the PDP and the PDP display of the second embodiment are substantially same as the structures in the first embodiment explained in accordance with FIGS. 1, 2, and 3, except for the structure of a middle layer and a protective layer. Therefore, the explanation on the same components are not provided.

In the above first embodiment, the seed crystals to be the base material for the columnar crystals are formed by performing the heat treatment to the grain crystals made of MgO. As the base material, however, a substance other than MgO can be used.

Figure 8:
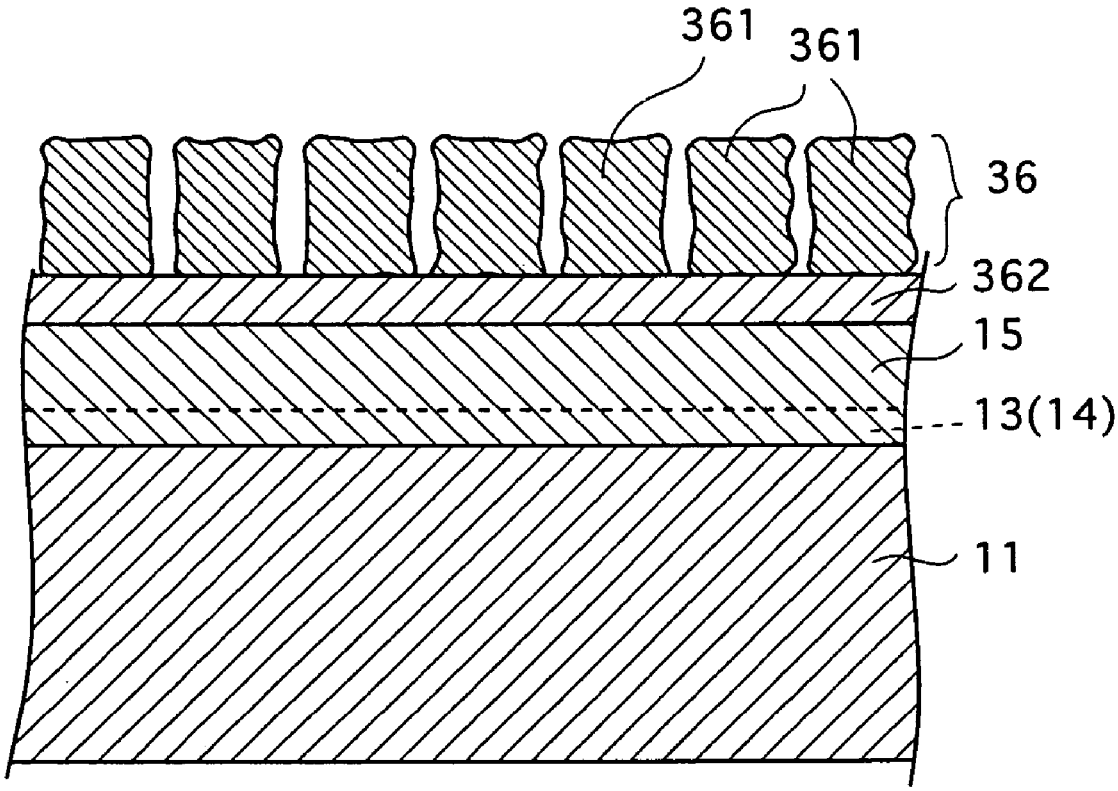
FIG. 8 is a sectional view of the main part of a front panel of a PDP according to the second embodiment.

FIG. 8 is a sectional view of the main part of a front panel according to the second embodiment.

As shown in FIG. 8, in a front panel according to the second embodiment, a dielectric layer 15 is layered so as to cover display electrodes 13 and display scanning electrodes 14 formed in parallel lines on one of main surfaces of a front glass substrate 11, and further, a middle layer 362 and a protective layer 36 are formed on the dielectric layer 15.

The middle layer 362 is a layer made of zinc oxide (ZnO). The result of observation of the middle layer 362 made of zinc oxide using the X-ray diffraction method shows that the layer has a wurtzite structure and (100) plane orientation. On a surface of the middle layer 362, the protective layer 36 is formed in epitaxial growth. A TEM observation on the boundary between the protective layer 36 and the middle layer 362 shows a lattice match between the layers.

Generally, in order to cause an epitaxial growth, it is considered empirically that the misfit should fall within a range of 10-15% inclusive. The misfit is a value indicated in percentage lead by dividing (i) an absolute value of the difference between an interatomic spacing of crystals in the base material and an interatomic spacing of another kind of crystals grow on the base material by (ii) the interatomic spacing of crystals in the base material. Therefore, when the misfit between the substances of the middle layer 362 and the protective layer 36 is 15% or below, and preferably, 10% or below, the substance to form the protective layer 36 can grow epitaxially. Note that the misfit of zinc oxide used in the second embodiment is 12%.

The protective layer 36 is a layer in which a plurality of columnar crystals 361 made of MgO grow epitaxially in substantially vertical direction to the surface of the middle layer 362. Like the columnar crystals 161 (FIG. 3), the columnar crystals 361 are basically made thicker in comparison with the conventional columnar crystals. By this, from the same reason with the first embodiment, the absorption of impurities to the protective layer 36 is suppressed in comparison with the conventional art, and thus the discharge characteristic of the PDP can be stabilized.

The result of observation of the columnar crystals 361 made of MgO using the X-ray diffraction method shows that the columnar crystals 361 have a rocksalt structure (sodium chloride structure) and are in (111) plane orientation from the boundary between the middle layer 362 to the surface of the protective layer 36. Note that, for the protective layer 36, it is also possible to use an alkaline earth metal oxide, an alkaline earth metal fluoride, and a mixture of the two.

[Method of Forming the Front Panel]

A method for manufacturing a PDP of the second embodiment is basically the same as the method explained in the first embodiment, and only differs in that the formation method of the front panel. Therefore, an explanation about the method of the front panel formation is mainly given below.

Figure 9A:
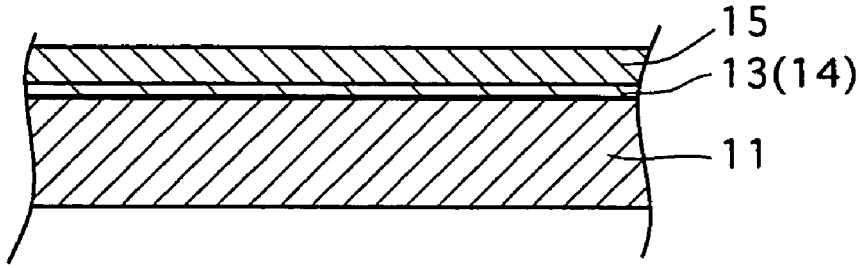
FIGS. 9A-9C are sectional views of the main part of the front panel according to the second embodiment, each showing each manufacturing step proceeding in an alphabetic order.
Figure 9B:
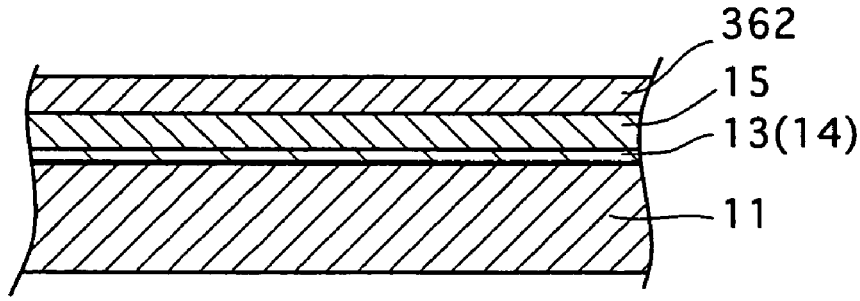
Figure 9C:
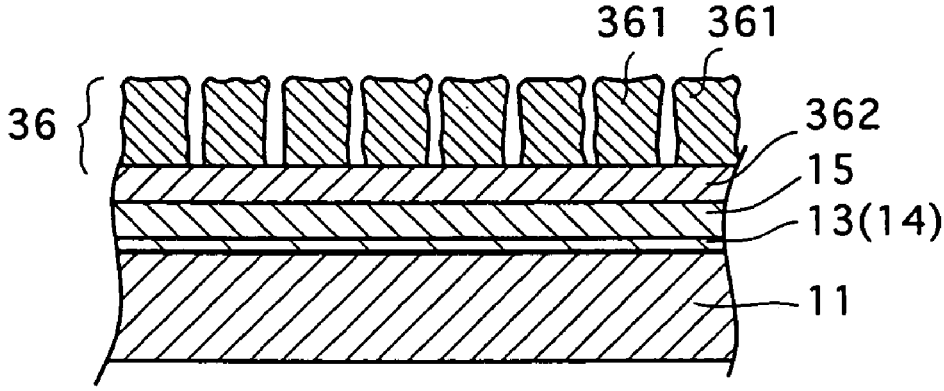

FIGS. 9A-9C are sectional views of the main part of the front panel according to the second embodiment.

Each drawing of FIG. 9A-9C shows each manufacturing step proceeding in an alphabetic order. An explanation about the method for manufacturing the display electrodes 13, the display scanning electrodes 14, and the dielectric layer 15 on the front glass substrate 11 is not given below, because the formation method is the same as the method explained in the first embodiment with reference to FIGS. 6A and 6B.

The front panel is manufactured by forming the middle layer 362 and the protective layer 36 on the dielectric layer 15 coating the display electrodes 13 and the display scanning electrodes 14 disposed in stripes on the front glass substrate 11.

First, as shown in FIG. 9A, the substrate on which the dielectric layer 15 is formed is heated, and by using a vacuum evaporation method such as EB evaporation in reduced-pressure atmosphere containing oxygen, zinc oxide (ZnO) is adhered to a surface of the dielectric layer 15 so as to be about 100 nm in thickness. Then, the middle layer 362 having (100) plane orientation in a thickness direction of the layer as shown in the FIG. 9B is formed.

In order to suppress the adhesion of impurities to the middle layer 362, the vacuum evaporation such as EB evaporation is carried out, while maintaining the reduced-pressure status, to the substrate on which the middle layer 362 is formed, so as to encourage an epitaxial growth of MgO to be 900 nm. By this, the protective layer 36 made of the columnar crystals 361 in (111) plane orientation uniformly in a thickness direction.

[Reasons Why the Columnar Crystals 361 Are Formed Thick]

An explanation about the growth rate is given here in order to explain the reason why the columnar crystals 361 are formed thick.

The columnar crystals 361 has anisotropy in surface energy of crystal planes, and accordingly, the growth rate on each crystal plane is different one another. The surface energy of the crystal plane is the physical quantity indicating the stability of the crystal plane. The larger value in the quantity indicates the greater number of interatomic linkage per unit area, and thus it is considered that the capability of absorbing atoms of the crystal plane.

The values for surface energy of MgO (relative value) are:

1.000 for (100) plane, and 1.732 for (111) plane.

As have been shown by those values, MgO having (111) plane is more easily absorb atoms in comparison with MgO having (100) plane.

In a practical sense, however, in a case where an MgO protective layer is formed by vacuum evaporation, the crystal growth is carried out in atmosphere containing $O_2$ in order to suppress oxygen defect in crystals. Such $O_2$ is susceptible to absorption in (111) planes of MgO crystals, and once absorbed, the (111) plane becomes stable and the surface energy decreases. As a result, the surface energy of (100) planes of MgO increases relatively, and MgO used as an evaporation source becomes susceptible to absorption in (100) planes of MgO crystals, and thus the crystal growth rate in (100) plane increases.

Note that if the crystal nuclei at the surface of the middle layer 362 have (111) orientation in a thickness direction of the protective layer 36, by encouraging growth at (100) plane of the crystal nuclei, the crystals grow toward the <100> direction which is at the right angles to the direction of thickness of the protective layer 36, and accordingly the columnar crystals 361 can be formed thick.

Because MgO has a rocksalt structure (sodium chloride structure), when vacuum evaporation is carried out in order to form a layer on an amorphous dielectric layer, the most close-packed atomic plane (100) becomes parallel to the plane of the dielectric layer, and therefore it is common that the crystals grow in (100) plane orientation in a thickness direction. However, in a case where MgO is vacuum evaporated on the crystal substrate, it is possible to control the orientation plane of crystal of MgO, using the difference in the structure of a crystal substrate.

Examples of crystal structures of such a crystal substrate include a face-centered cubic lattice and a hexagonal close-packed lattice. The most close-packed atomic plane of the face-centered cubic lattice is (111) plane, and the most close-packed atomic plane of the hexagonal close-packed lattice is (001) plane. In both lattice structures, (111) plane and (001) plane easily become parallel to the substrates. On those planes, atoms are arranged at apex of an equilateral triangle.

The structure on (111) plane of a rocksalt structure (sodium chloride structure) is similar to the above, and the arrangement is the same as (111) plane of the face-centered cubic lattice and (001) plane of the hexagonal close-packed lattice. Accordingly, if the crystals forming the middle layer 362 has (111) plane orientation of the face-centered cubic lattice or (001) plane orientation of the hexagonal close-packed lattice, then MgO having a rocksalt structure (sodium chloride structure) can easily grow into crystals with (111) plane orientation.

In order that the crystals of MgO grow in (111) plane orientation as explained above, binary system compounds and multi-element mixed crystal compounds with a zincblende structure and a wurtzite structure can be also used, other than the face-centered cubic lattice and the hexagonal close-packed lattice.

A brief summary of the crystal growth of the protective layer (MgO) is given below.

In the case where MgO is evaporated onto an amorphous dielectric layer as in the conventional art, many of the crystal nuclei formed here have (100) plane orientation in the most close-packed atomic plane which is parallel to the dielectric layer. When forming a layer with MgO in an $O_2$ atmosphere after that, the crystals grow on (111) plane selectively, and finally a layer in (111) plane orientation with a layer formed in the early stage of the growth as a dead layer.

On the other hand, as shown in the second embodiment, in a case where the middle layer 362 formed on the dielectric layer 15 is formed by crystals in (111) plane orientation in a thickness direction of the layer, the middle layer functions as a crystal nucleus, and by forming a layer of MgO on the middle layer, the columnar crystals 361 having a large diameter in (111) single orientation plane can be obtained, without a dead layer being formed.

The columnar crystals 631 are formed epitaxially, and a columnar crystal having a large diameter is easily formed, if conditions regarding misfit with the substance comprising the middle layer 362 are filled.

The Method of Deriving the Misfit.

In a case where the substance forming the middle layer 362 is made of crystals having the face-centered cubic lattice or the zincblende structure, the misfit with the columnar crystals 631 is derived by using the lattice constant as the closest interatomic spacing, because both structures are based on the face-centered cubic lattice.

On the other hand, in a case where the substance forming the middle layer 362 is made of crystals having the hexagonal close-packed lattice or the wurtzite structure, the misfit with the columnar crystals 631 is derived from $a/\sqrt{2}$, when the lattice constant is a, as the closest interatomic spacing. In order to establish the epitaxial growth, the smaller the misfit is, the more desirable it becomes. In general, it is preferable that the misfit is about 15% or lower, and more preferably, 10% or lower.

Here, substances that have one of the face-centered cubic lattice, the hexagonal close-packed lattice, the wurtzite structure, and the zincblende structure, that can be used for the middle layer 362 are listed below.

FIG. 10 is a table showing names of substances that can be used for the middle layer 362 and the misfit to MgO of these substances.

As shown in the table, the substance that can be used for the middle layer 362 is a single crystal of an element selected from a first element group consisting of Ag, Al, Au, Be, Cd, Co, Cu, Ga, Hf, In, Ir, Mg, Ni, Os, Pd, Pt, Re, Rh, Tc, Ti, Zn, and Zr, or an alloyed metal made of at least two elements selected from the first element group, and a compound crystal made of at least one element selected from the first element group and at least one element selected from a second element group consisting of As, N, O, P, S, Sb, Se, and Te. More specifically, Ag, Al, Au, Ca, Ce, Cu, Ir, Ni, Pb, Pd, Pr, Pt, Rh, Sc, Th, and Yb that forms the face-centered cubic lattice; Be, Cd, Co, Cp, Dy, Er, Gd, Hf, Ho, La, Mg, Nd, Os, Re, Tb, Tc, Ti, Tl, Tm, Y, Zn, and Zr that forms the hexagonal close-packed lattice; ZnS, ZnSe, ZnTe, CdTe, BeS, AlAs, AlP, AlSb, GaAs, GaP, GaSb, InAs, InP, and InSb that forms the zincblende structure; and ZnO, BeO, CdS, CdSe, AlN, an GaN that forms the wurtzite structure are shown in the table. In the table, the misfit to MgO of the substances marked with underlines are 15% or lower, and are especially suited for the middle layer 362 in terms with epitaxy; those substances are Ag, Al, Au, Cu, Ir, Ni, Pd, Pt, Rh, Cd, Co, Hf, Mg, Os, Re, Tc, Ti, Zn, Zr, ZnO, BeO, AlN, and GaN. Note that it is also possible to use an alloyed metal or a multi-element compound for the middle layer 362, if the alloyed metal or the multi-element compound is made of more than two substances selected from the group of substances that can form the middle layer 362.

As have been explained, by forming the middle layer 362 which is in (111) plane orientation in a thickness direction, and evaporating MgO, which forms the protective layer 36, on the middle layer, the columnar crystals 361 made of MgO are formed thick in comparison with the conventional art. Accordingly, the exposed surface of the entire protective layer 36 can be reduced and the amount of impurities such as water absorbed into the protective layer 36 is suppressed in comparison with the conventional art. Therefore, it is possible to make the discharge characteristic of PDP stable.

Note that, in such a case where crystals grow epitaxially, when crystals having different lattice constants are in a heterojunction, strain in the crystal structure of each kind of crystals may occur, where the lattice constant of each kind of crystals at the heterojunction surface becomes closer to one another. It is known that the amount of strain depends on the film thickness of each crystals. When the misfit becomes such large that the change in the crystal structure cannot be absorbed any more, dislocation of atoms occurs in the crystals. When the dislocation occurs, the lattice structure of the columnar crystals 362 made of MgO becomes un-uniform. However, this does not cause any serious effect to the function of the protective layer, or the electron emission property, although a slight change in the energy status can be observed.

In addition, in the process of the protective layer formation, if the partial pressure of $O_2$ in the vacuum evaporation is too large, the columnar crystals are susceptible to becoming smaller or grain crystals due to the slow down in the growth rate of the crystal nuclei as well as the increase in the nucleation. Therefore, it is preferable that the best appropriate partial pressure must be selected as the partial pressure of $O_2$.

Third Embodiment

Next, the explanation about a PDP and a Plasma display device of the third embodiment of the present invention is given. The PDP and the PDP display of the third embodiment have constructions which are substantially same as the constructions explained in the first embodiment with reference to the FIGS. 1, 2, and 3, except for constructions of a dielectric layer and a protective layer. Therefore, the explanation about the same construction is not given.

In the first embodiment explained above, by performing heat treatment on the grain crystals made of MgO, the seed crystals are formed for deciding the orientation plane of the columnar crystals formed on the seed crystals. However, instead of forming seed crystals, it is also desirable to decide the orientation plane of columnar crystals by changing the shape of a dielectric layer on which the columnar crystals are formed.

Figure 11:
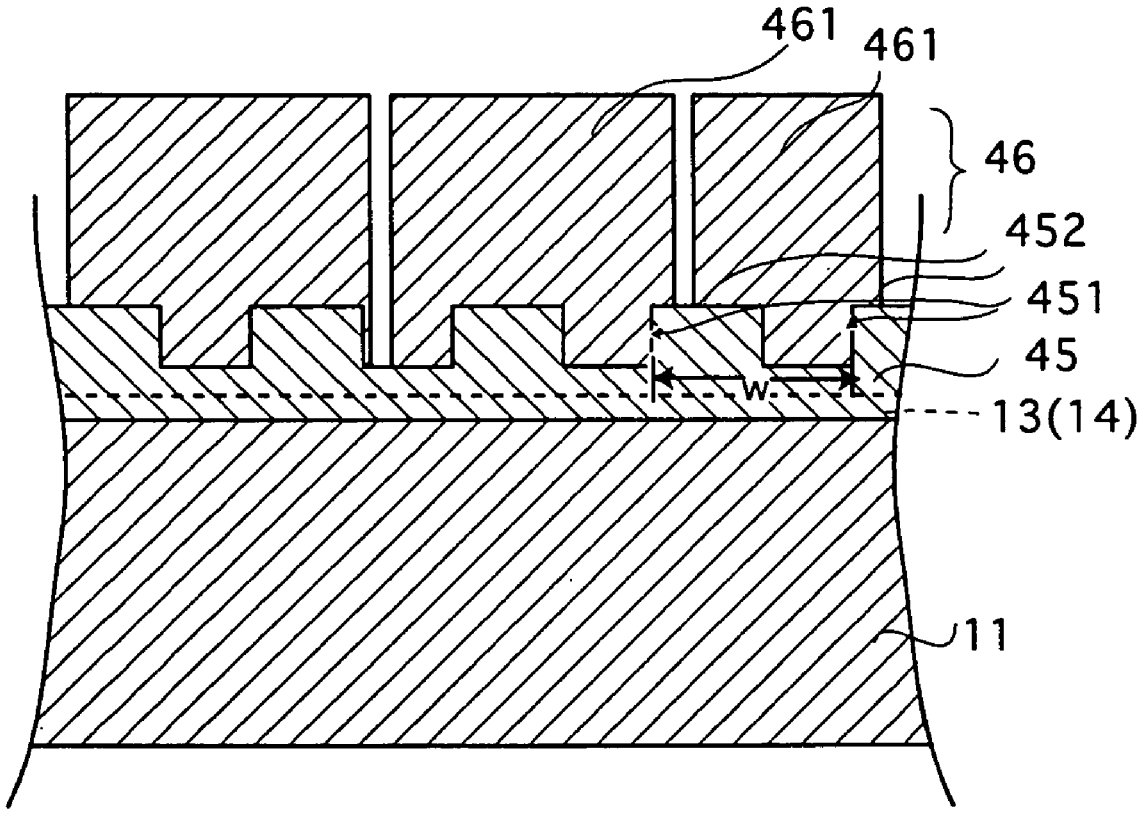
FIG. 11 is a sectional view of the main part of a front panel of a PDP according to the third embodiment

FIG. 11 is a sectional view of the main part of a front panel according to the third embodiment.

As shown in FIG. 11, the front panel of the third embodiment is such that a dielectric layer 45 is layered on one of main surfaces of a front glass substrate 11 so as to cover display electrodes 13 and display scanning electrodes 14, and a protective layer 46 is formed on the dielectric layer 45.

The dielectric layer 45 is made of an amorphous substance such as lead glass like the first embodiment, having plural grooves 451 in stripes on a surface which contacts the protective layer 46. The grooves 451 are such that cycle W is 3800 nm (the width of the groove is 1900 nm), depth H is 100 nm. By these grooves, the protective layer 46 on the dielectric layer 45 is formed single-crystal-like, which means that a fewer number of columnar crystals exist in the protective layer and that a diameter of each columnar crystal becomes larger. Note that it is confirmed that the protective layer 46 can be formed single-crystal-like when the width of the groove 451 is within a range of 160-3800 nm inclusive.

The protective layer 46 is made of a plurality of columnar crystals 461 made of MgO. The columnar crystals 461 are basically the same as the columnar crystals 161 (FIG. 3) in the first embodiment, and the diameter is formed larger than the columnar crystals of the first and the second embodiments. By this, from the same reason as in the first embodiment, the amount of absorption of impurity to the protective layer 46 can be suppressed in comparison with the conventional art, and accordingly, it is possible to stabilize electron discharge property of a PDP.

The result of observation of the columnar crystals 461 using the X-ray diffraction method shows that the columnar crystals 461 have a rocksalt structure (sodium chloride structure) and are in (100) plane orientation in a thickness direction of the protective layer 46. Note that, as a substance for forming the columnar crystals 461, it is also possible to use an alkaline earth metal oxide, an alkaline earth metal fluoride, and a mixture of the two.

[Method of Forming the Front Panel]

A method for manufacturing a PDP in the third embodiment is basically same as the method explained in the first embodiment, and only differs in that the formation method of the front panel. Therefore, an explanation about the method of the front panel formation is mainly given below.

FIGS. 12A-12D are sectional views of the main part of the front panel according to the third embodiment, each showing each manufacturing step proceeding in an alphabetic order. Note that an explanation about the method for manufacturing the display electrodes 13, the display scanning electrodes 14, and the dielectric layer 45 on the front glass substrate 11 is not given below, because the formation method is the same as the method explained in the first embodiment with reference to FIGS. 6A and 6B.

The front panel is manufactured by forming the protective layer 46 on the dielectric layer 45 coating the display electrodes 13 and the display scanning electrodes 14 disposed in stripes on the front glass substrate 11.

Figure 12A:
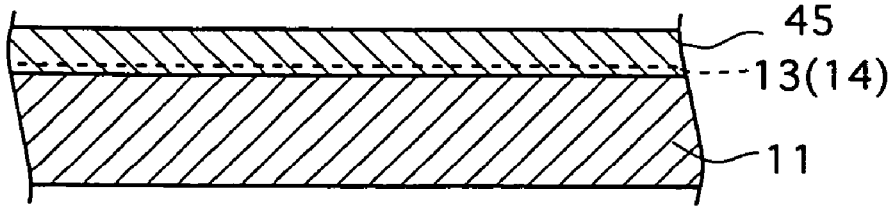
FIGS. 12A-12D are sectional views of the main part of the front panel according to the third embodiment, each showing each manufacturing step proceeding in an alphabetic order.
Figure 12B:
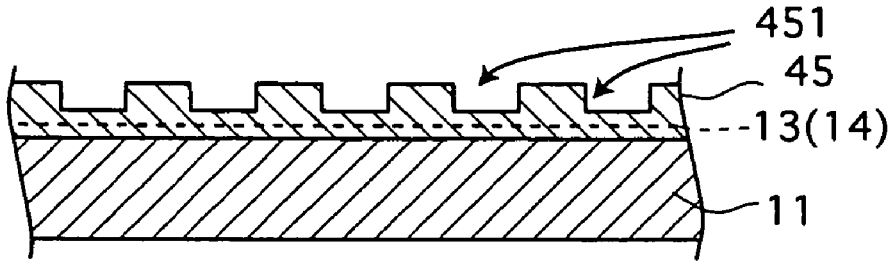
Figure 12C:
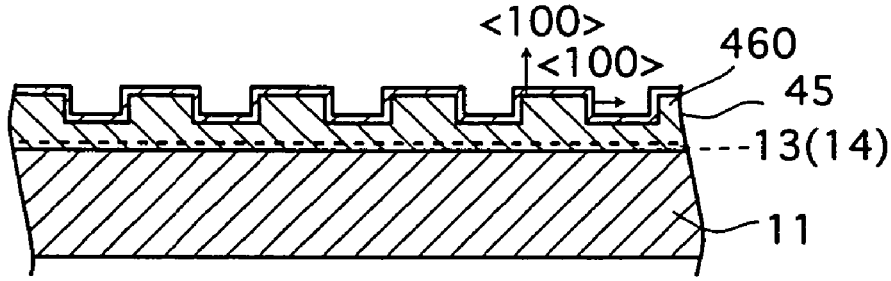

First, on the substrate on which the dielectric layer 45 is formed as shown in FIG. 12A, the plural grooves 451 are provided in stripes. Methods for providing the grooves include such as etching by a chemical etching method, melting a part of the dielectric layer 45 by a excimer laser method, or machinery curving a part of dielectric layer 45 where a cutting tool having needle-shaped edge is pushed against the dielectric layer and relatively moved.

Next, the substrate on which the grooves are provided is heated up, and by a vacuum evaporation method such as EB evaporation on the surface of the dielectric layer 45, MgO to be material of the protective layer is adhered to the entire surface of the dielectric layer 45.

Figure 13:
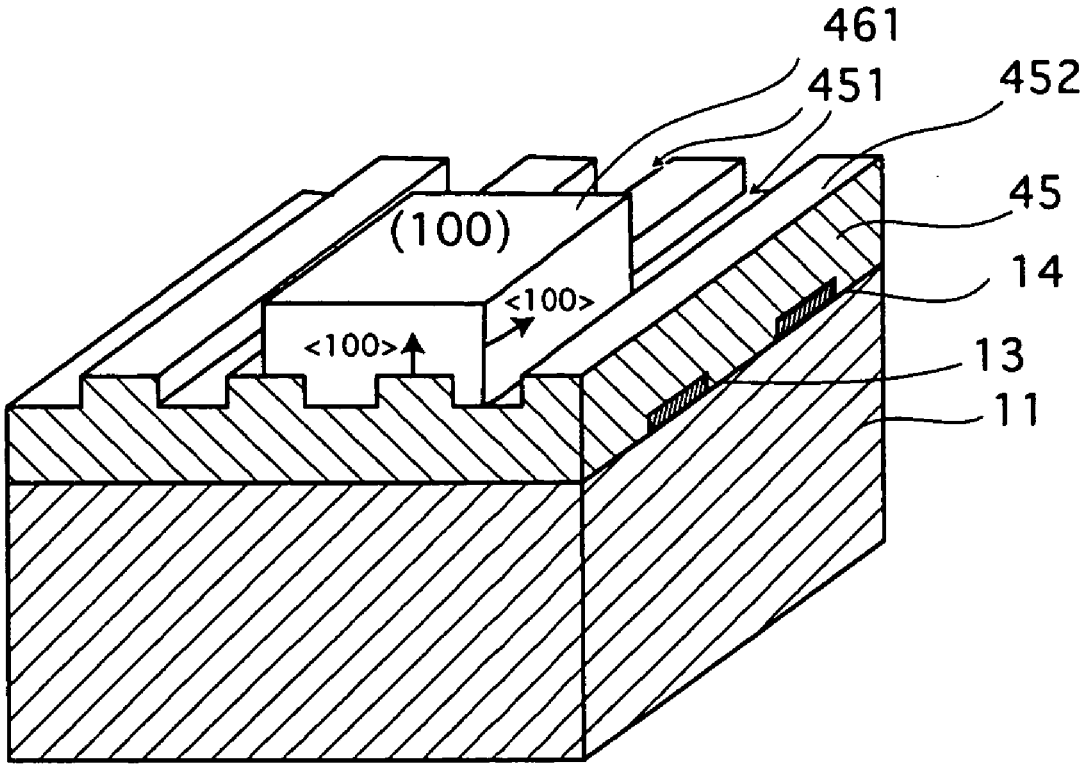
FIG. 13 is a sectional perspective view schematically showing the main part of the front panel of the third embodiment.

FIG. 13 is a sectional perspective view schematically showing the main part of the front panel of the third embodiment. In this figure, only one columnar crystal is shown for purpose of explanation.

Figure 12D:
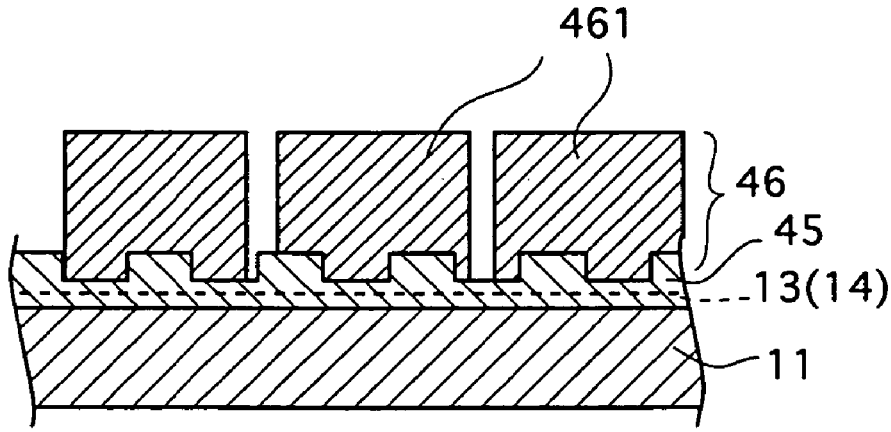

The dielectric layer 45 itself is amorphous, and accordingly as shown in FIG. 13, MgO evaporated onto the dielectric layer 45 grows in <100> direction in theory. Therefore, not only on surfaces of convexes 452, but also bottom surface and side surfaces of the grooves 451, MgO grows in <100> orientation to substantially vertical direction to each plane. Accordingly, in the grooves 451, MgO grows lengthwise of the grooves in <001> orientation, and as a result, grows into a precursor 460 for the protective layer (FIG. 12), which is single-crystal-like and has dual axis orientation along the groove 451. By continuously evaporating to the precursor 460 for the protective layer, columnar crystals 461 in (100) plane orientation in a thickness direction. The diameter of the columnar crystals 461 grow as large as possible to a degree that the protective layer 46 can be regarded as one crystal. (Note that FIGS. 11 and 12D show cases where three columnar crystals 461 are formed.)

Even in a case where the precursor 460 for the protective layer is made of the grain crystals or an the amorphous layer in the first stage of MgO evaporation, by performing the heat treatment in reduced-pressure atmosphere containing oxygen using similar heating apparatuses as in the first embodiment, the precursor 460 for the protective layer can be polycrystallized and it is possible, as in the first embodiment, to make the diameter of the precursor 460 for the protective layer to be seed crystals larger in comparison with the conventional art. In the heat treatment, it is preferable to scan sliding at 12 μm pitch using an argon laser with 6-7 W which can irradiate with a spot diameter of about 380 μm, and to heat up to a crystal melting point T (K) and higher (in the case of amorphous layer, ⅔T (K) or higher), and to repeat it several times.

Then finally, the protective layer 46 has (100) plane orientation in a thickness direction, and becomes closer to a single crystal made of the columnar crystals that have a greater diameter than each of the embodiments explained above. Crystallinity of the precursor 460 for the protective layer after the treatment can be observed by carrying out electron beam diffraction.

As have been described, the front panel on which the columnar crystals 461 are formed on the precursor 460 for the protective layer as the seed crystals; the columnar crystals 461 are formed thicker than the same in the other embodiments, and the front panel does not comprise a dead layer made of grain crystals. Accordingly, discharge characteristic of a PDP can be stabilized.

Note that, while the protective layer 46 in (100) plane orientation is formed in the third embodiment, the protective layers formed in the first and the second embodiments are in (111) plane orientation. The difference in the orientation plane of the protective layers does not make much difference in terms with the stability of discharge characteristic. However, in terms with the electron emission property, (111) plane orientation is slightly better, and it is preferable to form the protective layer in (111) plane orientation in this regard. In order to form the protective layer having (111) plane orientation by forming grooves on the dielectric layer, the protective layer in (111) plane orientation in a thickness direction by forming the shape of the grooves to be tetrahedron-shape.

Moreover, in the third embodiment, it is preferable that processes are carried out without opening the air during from a period for adhering protective layer material through a period of forming the protective layer, and that the front panel is kept at a room temperature or higher during a period from the heat treatment through a period for forming the protective layer.

INDUSTRIAL APPLICABILITY

The PDPs according to the present invention can be applied to PDPs used for computers and television sets, especially, PDPs that are required to have long life.

The invention claimed is:

1. A plasma display panel in which a first panel and a second panel face each other with a spacing member sandwiched there between, a plurality of electrodes being disposed in stripes on one of the first and second panels, and a dielectric layer and a protective layer being layered in a stated order so as to cover the plurality of electrodes, wherein the protective layer includes a first layer made of seed crystals and a second layer made of a plurality of columnar crystals, the plurality of columnar crystals growing on the seed crystals, wherein the columnar crystals are MgO and the first layer includes an element selected from a first element group consisting of Ag, Al, Au, Be, Cd, Co, Cu, Ga, Hf, In, Ir, Ni, Os, Pd, Pt, Re, Rh, Te, Ti, Zn, and Zr, and the first layer is made of one of (i) the seed crystals formed by coalescing a plurality of grain crystals which adhere to the dielectric layer in an initial phase of the first layer formation, and (ii) the seed crystals formed by polycrystallization of an amorphous layer adhered to the dielectric layer in the initial phase of the first layer formation.

2. A plasma display panel according to claim 1, wherein the columnar crystals forming the protective layer have (111) plane orientation in a thickness direction of the protective layer.

3. A plasma display panel in which a first panel and a second panel face each other with a spacing member sandwiched there between, a plurality of electrodes are disposed in stripes on one of the first and the second panels, a dielectric layer being layered so as to cover the plurality of electrodes, and a protective layer being positioned above the dielectric layer, wherein a middle layer is disposed between the dielectric layer and the protective layer, the middle layer being a base material on which columnar crystals grow so as to form the protective layer, wherein the middle layer is made of one of single crystals, alloyed metal, and compound crystals, the single crystals being made of an element selected from a first element group consisting of Ag, Al, Au, Be, Cd, Co, Cu, Ga, Hf In, Ir, Ni, Os, Pd, Pt, Re, Rh, Tc, Ti, Zn, and Zr, the alloyed metal being made of at least two elements selected from the first element group, and the compound crystals being made of at least one element selected from the first element group and at least one element selected from a second element group consisting of As, N, O, P, S, Sb, Se, and Te.

4. A plasma display panel according to claim 3, wherein a crystal structure of the middle layer is one of a face-centered cubic structure, a hexagonal close-packed structure, a wurtzite structure, and a zincblende structure.

5. A plasma display panel according to claim 3, wherein a misfit of a substance of the middle layer to a substance of the protective layer is around 15% or lower.

6. A plasma display panel according to claim 3, wherein the columnar crystals forming the protective layer have (111) plane orientation in direction of thickness of the protective layer.

7. A plasma display panel according to claim 3, wherein the columnar crystals are made of MgO.

8. A plasma display device comprising:

a plasma display panel according to claim 3; and a driving circuit for driving the plasma display panel.

9. A method for manufacturing a plasma display panel in which a panel formation process having a first step for forming electrodes on a substrate, a second step for forming a dielectric layer so as to cover the electrodes, and a third step for forming a protective layer coating the dielectric layer, wherein the third step comprises:

a material adhering step for adhering material of the protective layer to the dielectric layer;

a heat treatment step for heat treating the material of the protective layer and forming seed crystals; and a protective layer forming step in which the material of the protective layer grows on the seed crystals; and in the material adhering step, a plurality of grain crystals made of the material of the protective layer are adhered to the dielectric layer, and in the heat treatment step, the grain crystals are heated up to a temperature T(K), wherein T(K) is a melting point of the grain crystals, or higher.

10. A method for manufacturing a plasma display panel according to claim 9, wherein the heat treatment step is carried out in reduced-pressure atmosphere.

11. A method for manufacturing a plasma display panel according to claim 9, wherein the heat treatment step is carried out in reduced-pressure atmosphere containing oxygen.

12. A method for manufacturing a plasma display panel according to claim 9, wherein the material adhering step and the heat treatment step are carried out at the same time.

13. A method for manufacturing a plasma display panel according to claim 9, wherein, during a period from the heat treatment step through the protective layer forming step, processes are carried out without opening the air.

14. A method for manufacturing a plasma display panel according to claim 9, wherein, during a period from the material adhering step through the protective layer forming step, processes are carried out without opening the air.

15. A method for manufacturing a plasma display panel according to claim 9, wherein, during a period from the heat treatment step through the protective layer forming step, processes are carried out in reduced-pressure atmosphere.

16. A method for manufacturing a plasma display panel according to claim 9, wherein, during a period from the heat treatment step through the protective layer forming step, the seed crystals are kept at a room temperature or higher.

17. A method for manufacturing a plasma display panel in which a panel formation process having a first step for forming electrodes on a substrate, a second step for forming a dielectric layer so as to cover the electrodes, and a third step for forming a protective layer coating the dielectric layer, wherein the third step comprises: a material adhering step for adhering material of the protective layer to the dielectric layer; a heat treatment step for heat treating the material of the protective layer and forming seed crystals; and a protective layer forming step in which the material of the protective layer grows on the seed crystals; and in the material adhering step, an amorphous layer made of the material of the protective layer is adhered to the dielectric layer, and in the heat treatment step, the seed crystals are formed by heat treating and polycrystallizing the amorphous layer.

18. A method for manufacturing a plasma display panel according to claim 17, wherein, in the heat treatment step, the amorphous layer is heated up to a temperature of ⅔ of T(K), wherein T(K) is a melting point of the amorphous layer, or higher.

19. A method for manufacturing a plasma display panel according to one of claims 9 and 18, wherein, in the heat treatment step, the heat treatment is carried out by irradiating an energy beam to the material of the protective layer, the energy beam being emitted from one of a laser irradiating unit, a lamp irradiating unit, and an ion irradiating unit.

20. A method for manufacturing a plasma display panel according to claim 19, wherein, in the heat treatment step, irradiation is carried out in a manner that the energy beam is moved relatively to the substrate on which the material of the protective layer is adhered.

* * * * *